United States Patent [19]

Tipple et al.

[11] 4,441,831

[45] Apr. 10, 1984

[54] APPARATUS FOR EMBOSSING PLATES OF DIFFERENT SIZES AND SHAPES

[75] Inventors: Neil A. Tipple, Torrance; Jerome W. Gibson; Ronald J. Boyd, both of Northridge, all of Calif.

[73] Assignee: DBS, Inc., Randolph, Mass.

[21] Appl. No.: 137,216

[22] Filed: Apr. 4, 1980

[51] Int. Cl.[3] ..... B41J 1/22

[52] U.S. Cl. ..... 400/134.3; 400/134.2

[58] Field of Search ..... 400/127, 129, 130, 131, 400/132, 133, 134, 134.1, 134.2, 134.3, 624, 625, 628; 101/18, 29

[56] References Cited

U.S. PATENT DOCUMENTS

| | | | |
|---|---|---|---|
| 2,528,435 | 10/1950 | Isett | 400/625 X |
| 2,833,386 | 5/1958 | Hueber | 400/625 X |
| 2,973,853 | 3/1961 | Freedson | 400/625 X |
| 4,091,910 | 5/1978 | Bolton et al. | 400/134.2 X |

*Primary Examiner*—Ernest T. Wright, Jr.
*Attorney, Agent, or Firm*—Gerald J. Ferguson, Jr.; Joseph J. Baker

[57] ABSTRACT

A machine for embossing cards or plates is provided with features which give it the capability of handling and feeding a wide variety of plate sizes both in length and height, and also make it possible to effectively process pieces which are of many unusual non-rectangular shapes. A trackway made up of several segments is arranged to have a rail of each segment readily adjustable towards and away from the other rail. Special hopper and receiver equipment is made available which can accept plates of different lengths by merely adjusting fixed side rails which cooperate with trays which are substantially standardized for the novel system. The plate holding means at the embossing station is so constructed that it can effect its retention function without inhibiting embossment on the margins or other portions of the plate regardless of its unusual size or shape limitations. Slightly modified alternate tray constructions are provided for easily accommodating, feeding and storing plates of more unusual outline. As a result a machine may be quickly modified, by simple and inexpensive adjustment or very modest part replacement, to handle any of a wide variety of workpiece configurations.

39 Claims, 22 Drawing Figures

Fig. 1
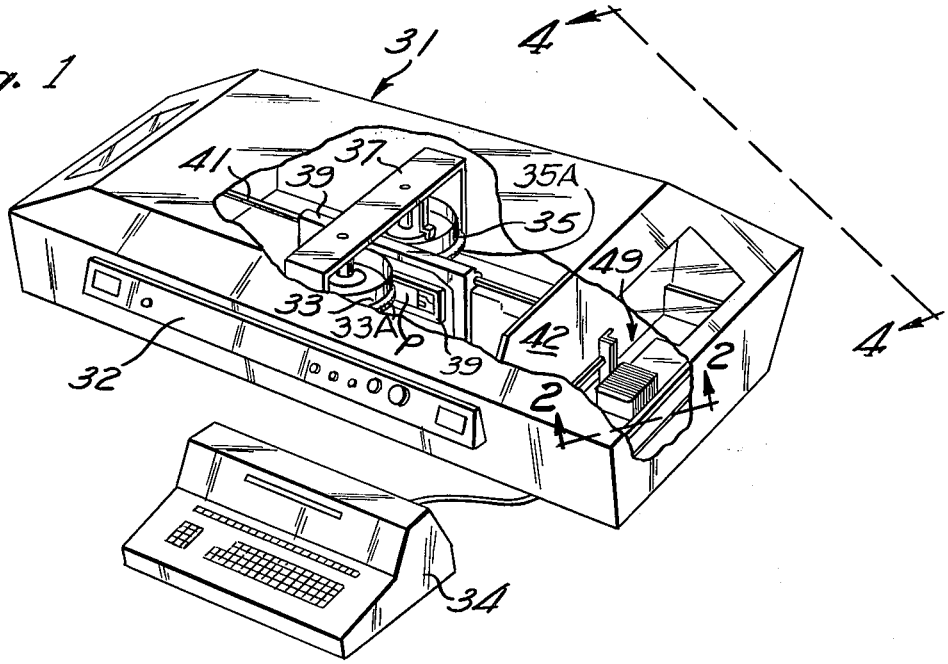
Fig. 2
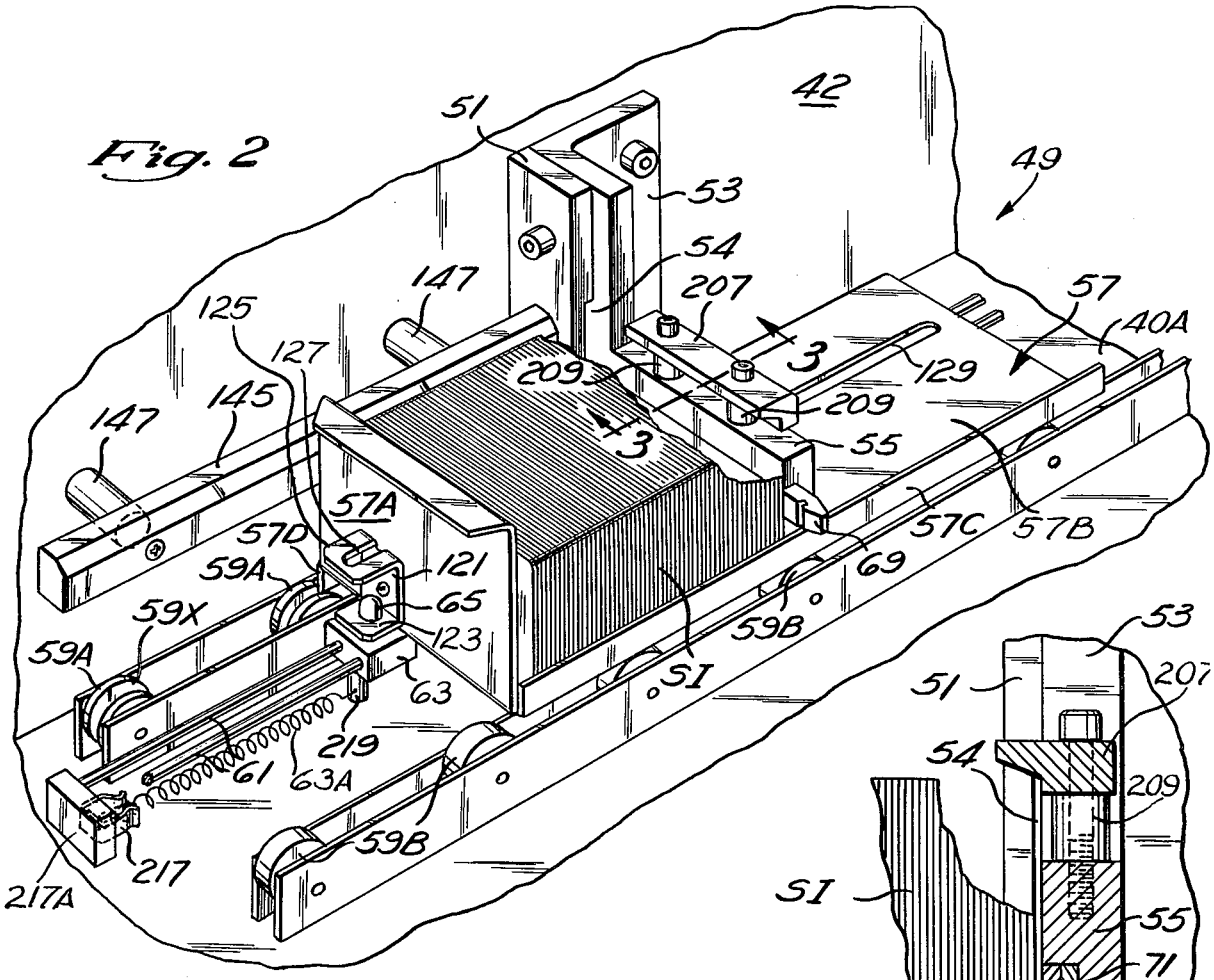
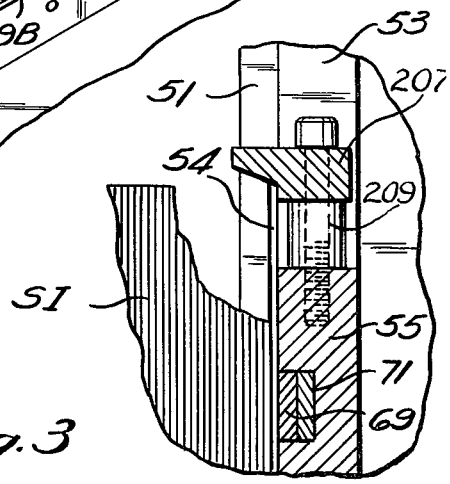
Fig. 3

Fig. 10
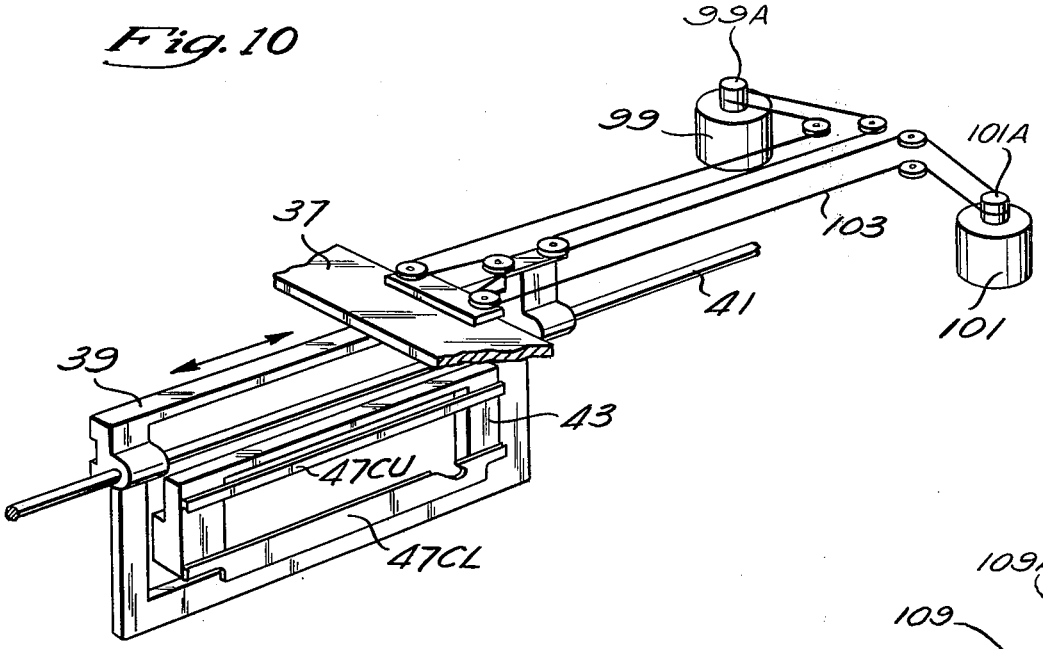
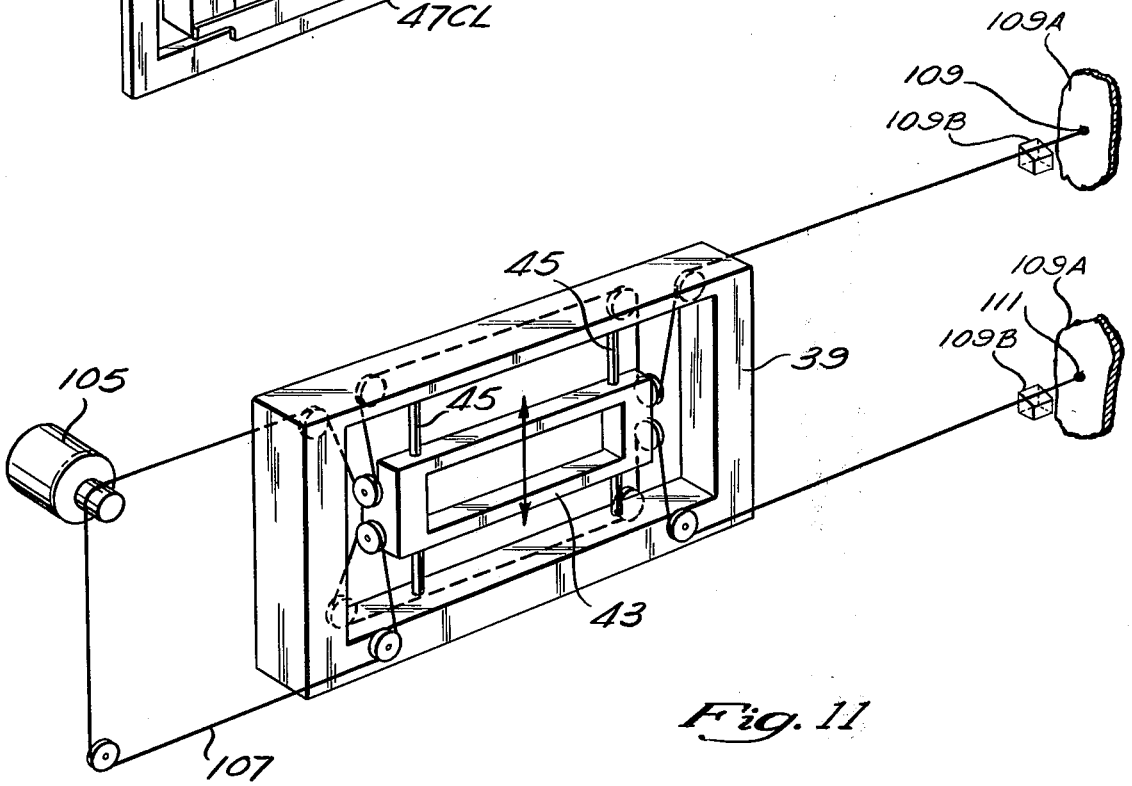
Fig. 11

APPARATUS FOR EMBOSSING PLATES OF DIFFERENT SIZES AND SHAPES

BACKGROUND OF THE INVENTION

This invention relates to the field of embossing machines, and is preferably used in connection with the type of embossing equipment illustrated in the U.S. patent to Bolten et al, U.S. Pat. No. 4,091,910. Since the introduction of equipment in accordance with the Bolton patent, various changes and improvements have been made to render the machine more automatic in operation and particularly to carry out the storing of blank cards or plates in a hopper, feeding them from the hopper to the embossing location, and from there to a receiver so that the entire procedure can proceed with minimum operator intervention. This equipment, known as the AM Addressograph E300 Embosser, involved first the use of a frame system arranged centrally of the machine to position a plate during embossing so that the characters are embossed in sequence on the proper line and at the proper positions along the line. The frame system was made up of an inner frame having parallel rails with grooves forming a movable track segment in which the upper and lower edges of the plate could be slidably received. This inner frame also carried means for trapping and registering the plate at a predetermined location along the movable track segment in response to its being slid into the movable track segment from the input end. The inner frame was vertically shiftable on guides carried by the outer frame, which in turn was horizontally shiftable on fixed guides running parallel to the character lines on the embossed plate. Both frames were arranged to be positioned along their guides by electrically controlled mechanism, including cables and stepping motors, in such manner as to place the plate in proper position for embossing each character thereon. The drive system for the horizontally shiftable frame had two modes of operation, one a step by step locating mode for sequential character embossing, and the other an extended travel mode for allowing the inner frame tracks to receive or discharge plates.

At the input end of the machine there was a hopper for holding a stack of unembossed plates and advancing them stackwise to a picking position, and fixed upper and lower rails forming a fixed track segment for receiving a plate picked from the stack and guiding it into the machine.

At the output end the arrangement was somewhat similar in that there was provided a fixed exit track segment and a receding stack receiver for accepting and holding the embossed plates in stacked relationship. Horizontally oscillating cursors were also provided for driving picker and pusher elements to withdraw a blank plate from the hopper and step it along through the track, finally moving an embossed plate into the receiver. These were driven in proper timed relationship by a cable system and electric motors.

The operating sequence of this mechanism called for the horizontally shiftable frame to move the track segment of the inner or vertically moving frame into close register with the fixed track segment at the input end. Then the picker slider would be activated to draw a fresh plate from the hopper stack through the input fixed track segment and to move a waiting plate onto the movable track segment where it would be trapped or latched in place. Thereafter the horizontally movable frame would carry the plate to a central location between the embossing punches and dies where the motions required during the embossing operation would be carried out by the drives for the vertically and horizontally movable frames. Upon completion of embossing, the vertically moving frame would be restored to the datum position and the horizontally moving frame would be shifted by its drive until the movable track segment on the vertically moving frame was in close register with the end of the fixed track segment on the output end, whereupon pusher elements would be activated to move the embossed plate to the fixed track segment and place another waiting card on the face of the stack in the receiving stacker.

The correct positioning of the plate on the movable track section was controlled by an inlet trapping member which normally blocked the track but could be swung aside by the incoming plate as it arrived. The trapping member was hinged to swing about a horizontal axis adjacent the upper rail, and spring pressed to return after the plate had passed. At a location about one plate length from the inlet trapping member was a retention member also positioned to block the track, hinged on a horizontal axis on the upper rail and spring urged both into blocking position and in a direction towards the plate along its hinge axis to serve as a return device to bring the plate back to its initial position after each embossment. This retention device was releasable only when the frame system was moved to release position adjacent the output track, at which time a fixed cam would displace the retention member laterally off the track to allow the pusher to move the plate onto the fixed output track segment. Because of their nature, the trapping means and the retention means would lie within the sweep of the rotary embossing heads if they were to occupy the same plane. Accordingly embossment of a narrow margin along the upper edge of a plate could not have been performed if required for any reason.

The equipment just described has operated very effectively and has given good service in usual embossing situations. Recently, however, applications have arisen in which there has been a requirement for embossing machines which can be made to accept plates of varying sizes and shapes. At the present time these applications relate primarily to automobile manufacture, but other needs for this capability undoubtedly exist. In situations where the need for embossed workpieces represents a rather low volume in comparison with such commonly embossed items as credit cards and the like, and where there are various types, sizes and shapes of plates which must be embossed, it is difficult to justify the cost of a number of highly automated embossers such as would be needed to handle several individual plate configurations. However, it has been determined that if there are a sufficiently large number of machines required at different locations it could be economically feasible to purchase or lease the machines, provided that each machine could be made to accommodate all of the various plate configurations in use by the customer, at least to the degree that a service man or a well trained operator could, with the substitution of a few readily accessible minor parts and some minor adjustment, effect a quick but fully operative conversion of the machine. No such machine has existed heretofore and customers with this particular type of requirement have had to be content with the inconveniences of embossers each designed to handle one particular configuration of workpiece with no possibility of switching from one machine to another for a particular plate configuration without undertaking a substantial rebuilding of the machine.

SUMMARY OF THE INVENTION

In accordance with this invention the conversion of embossing machines to deal with the embossing of cards or plates under circumstances where the workpiece may assume different sizes and shapes, and where the machine may be called upon from time to time to be adapted for use with any one of these sizes and shapes or to new sizes and shapes, has been reduced to a feasible and practical situation without in any way impairing the speed or effectiveness of the embossing process itself, and in a manner which permits embossing access to substantially all areas of the plate surface as is frequently required with specialized plates.

These unusual capabilities have been brought about by several interacting novel aspects of the machine construction including the following:

1. A modified mounting allows the upper track members throughout the workpiece path to be raised or lowered to accommodate the width (i.e. the height) of the plates to be used.

2. A novel hopper and plate receiver construction involving the use of repositionable supports for a fixed guide rail allows accommodation of plates of different lengths in substantially the same hopper or receiver mechanisms without in any way affecting the travel of the picker mechanism.

3. An adjustably positionable cutoff switch for the pusher drive motor provides for accommodating plates of different lengths in substantially the same hopper and receiver mechanisms without requiring any other modification of the pusher construction or plate receiver construction other than adjustment of the guide rail (mentioned in the preceding paragraph) to accommodate such differences in length of plates.

4. Provisions are made for readily adjusting the height of the picker and pusher elements to allow for so positioning them that (1) they can be brought into contact with the plate edge at the optimum point when the plate has an irregular contact edge, and (2) they can be set at an appropriate level for moving the plate through the tracks due to other variable factors (e.g. plate height vs. track contact length).

5. The plate retention means on the inner frame has been disassociated altogether from the upper rail of the trackway to allow ready adjustment of the rail to accommodate plate height. The configuration and mounting of the retention means has been wholly revised so that any portions which must necessarily fall within the sweep of the embossing heads are restructured to have a thickness only slightly greater then the plate being worked upon to thereby allow embossing access to all areas of plates of any configuration or size.

6. Plates of many unusual outlines can be readily handled in the trackway, and their accommodation in the hopper, stacker and throat areas are arranged for in a very simple manner by minimum modification to the plate stacking trays and the provision of overhead guides equipped with adjustable mounting features allowing their precise adjustment to plate configuration requirements, especially with regard to those situations involving plates with reduced lower track contact length.

7. The present invention takes into consideration the problem of embossed plates occasionally failing to stack regularly because of the interaction of the embossed portions, and provides on the trays a pressure equalizing spring means so configured as to act independently at horizontally spaced points on the plate stack. The spring means is also provided with alternate mounting devices which allow the spring to be set at various levels above the tray floor to accomodate plates of different heights or shapes.

8. Because plates may have irregularly shaped edges which would require them to be picked or pushed at locations spaced from a normal location for a rectangular plate, both the picker element and the pusher element are provided with mounting arrangement including elongate slot configurations making it possible to cause the picker and pusher strokes to be offset from the normal location by the required amount.

9. In order to simplify loading and unloading of plates a special retention means is provided to immobilize the tray-driving spring in its extended condition while a plate tray is being connected thereto or disconnected therefrom.

BRIEF DESCRIPTION OF THE DRAWINGS

FIG. 1 is an overall perspective view of an embossing machine in accordance with the present invention with parts of the cover broken away;

FIG. 2 is a perspective to a larger scale of the supply hopper for holding and feeding plates, take substantially on line 2—2 of FIG. 1, with part of the plate stack broken away;

FIG. 3 is a detail section to a still larger scale taken on a vertical plane identified by the line 3—3 of FIG. 2, with a part of the plate stack broken away;

FIGS. 10 and 11 are reduced diagrammatic perspectives illustrating the drive mechanisms for operating the outer horizontally moving frame and the inner vertically moving frame respectively;

DESCRIPTION OF THE PREFERRED EMBODIMENT

Figure 4:
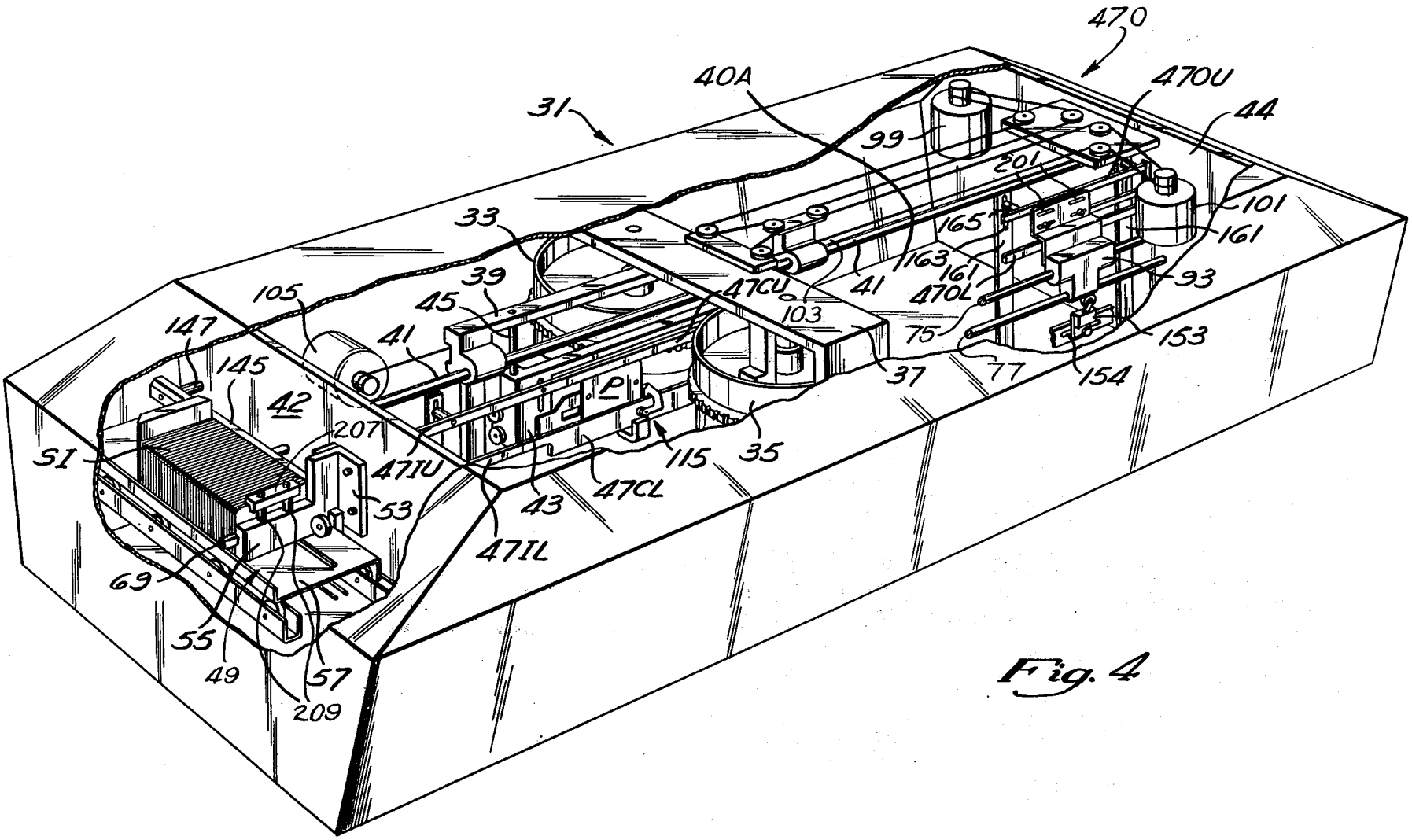
FIG. 4 is an overall perspective similar to FIG. 1 but to a somewhat larger scale and from a different direction, particularly as indicated by the arrows 4—4 in FIG. 1.

The embossing machine of the present invention is shown in FIGS. 1 and 4 and is designated by the numeral 31. The rotary embossing heads are indicated by the reference characters 33 and 35 mounted for rotation in a rigid structural member of frame 37. The embossing heads 33, 35 are of the type in which corresponding punch 33A and die 35A members are radially projected to grasp a workpiece or plate P between them as they constantly rotate, and to emboss the plate P with a progressive rolling action, thereafter releasing the plate P to allow it to be returned to a reference position in readiness for the embossment of another character. These heads 33, 35 and their operation are not described in detail herein, inasmuch as their relationship to the present invention is only incidental, and the details thereof can be found in U.S. Pat. No. 4,091,910, which is hereby incorporated by reference.

The machine is shown as having a control panel 32 and a keyboard 34 for signalling the machine 31 concerning the characters to be embossed. A number of alternate sources can, of course, be used in place of the keyboard 34 shown.

For manipulating the plate P to cause placement of the embossments at required locations, there is provided at a position adjacent the embossing site, i.e. surrounding the quasi nip formed by the rotary embossing heads 33, 35, a frame assembly comprising an outer frame 39 which is mounted for horizontal sliding movement on a rod 41 whose ends are supported on bulkheads 42 and 44, and an inner frame 43 which is vertically movable on vertical rods 45, 45 fixedly connected with the frame 39. These frames 39 and 43 can be more particularly seen in FIGS. 5, 6, 10 and 11.

Running the length of the machine 31 is a trackway 47 which guides plates P from the input end 47I (at the bulkhead 42) to the output end 47O (at the bulkhead 44). This trackway 47 is discontinuous and is made up of several segments. A general designation of 47 is applied to the entire trackway although this does not appear as an independent character on all drawings. The central segment of the trackway 47C consists of upper and lower rails 47 CU and 47 CL mounted on the inner frame 43 for movement therewith, and each rail 47 CU, 47 CL has a shallow groove 41A facing the other rail 47 CU, 47 CL to guide a plate P by its upper and lower edges. The input segment consists of upper and lower rails 47 IU and 47 IL suitably mounted on the machine base 40A in alignment with rails 47 CU and 47 CL, and the output segment is similarly made up of rails 47 OU and 47 OL also mounted in alignment with the segment 47 CU, 47 CL.

The input hopper for introducing plate P into the input track segment 47 IU, 47 IL is illustrated in FIGS. 1, 2, 3, and 4, and is generally designated 49. The bulkhead 42 has a vertical inlet slot (not shown in the drawing because it is coincident with throat 54) which is framed by the throat members 51 and 53 providing between then a throat 54. The member 53 has a bracket configuration which includes as a portion thereof a projecting arm 55 which constitutes an abutment for a supply stack SI of plates P being presented for embossment. The stack SI is carried on a tray 57 which is supported for free movement on rollers 59A and 59B. Between the rollers 59A and 59B is a pair of guide rods 61 which carries a travelling block 63 having an upright pin 65. Suitable spring means 63A (preferably a NEG-'ATOR® constant force spring) urges the block 63 in a direction to the right in FIG. 2 along with the tray 57 which is connected to the block 63 by a pierced tap 123 which receives the pin 65. The abovementioned spring 63A thus urges the tray 57, via the block 63, in a manner to cause the stack SI to be compressed between the abutment 55 and a head wall 57A on the tray 57 so that the foremost plate P in the stack SI is firmly held against the abutment 55 in line with the throat 54 as seen in FIG. 3.

To remove a plate P from the stack SI and bring it through the throat 54 and into the input track segment 47I, there is provided a picker element 69 which is slidable in a matching channel 71 formed in the face of the abutment 55.

Figure 5:
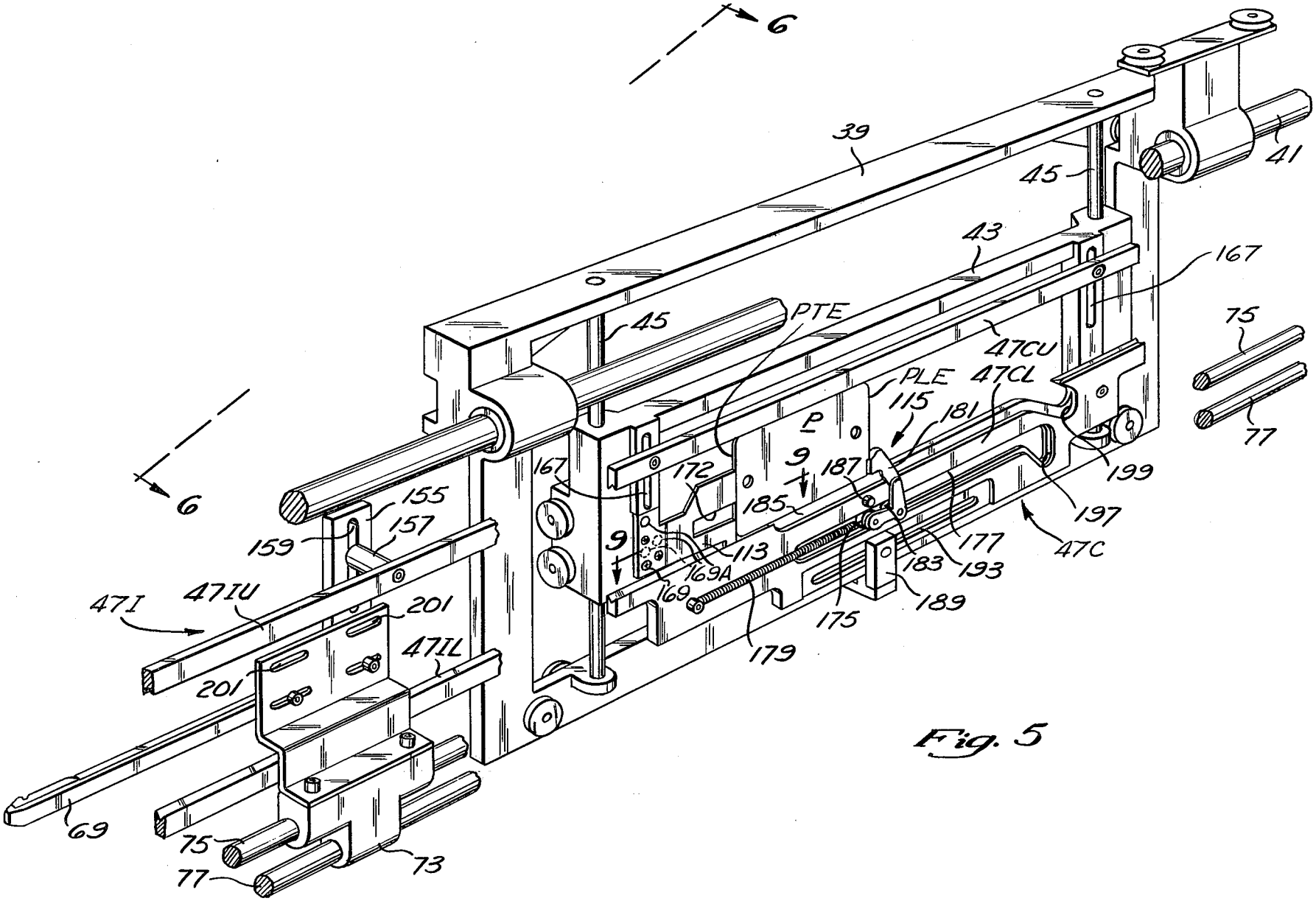
FIG. 5 is a detail perspective of the mechanism for guiding and controlling the plate on its path through the machine with particular emphasis on the input and central positioning aspects.
Figure 8:
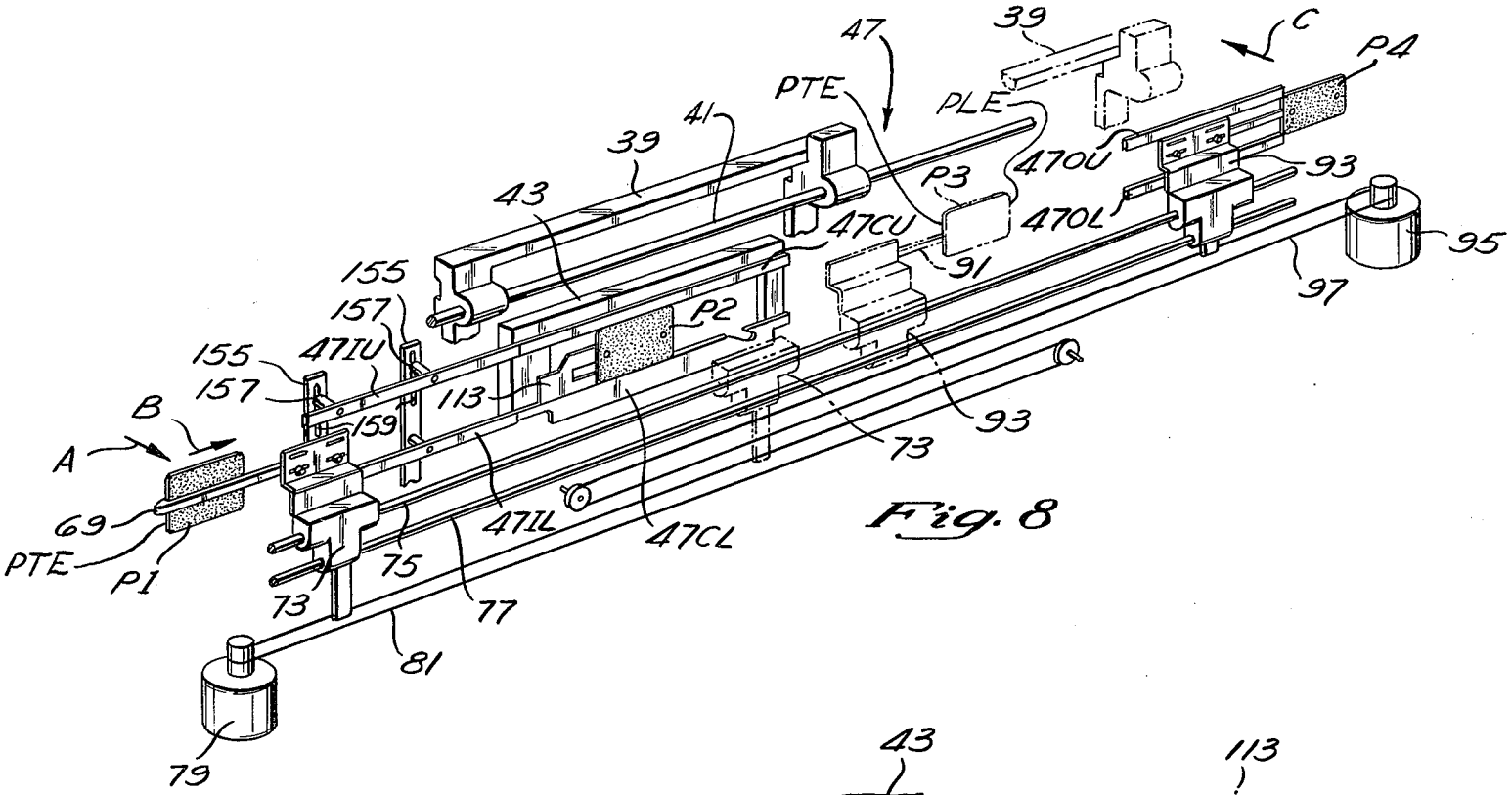
FIG. 8 is a diagrammatic perspective to a reduced scale showing the operation of the plate moving elements.

As seen in FIGS. 5 and 8, the picker element 69 is carried and driven by a slide or cursor 73 which rides along the guide rods 75, 77. Its motion is brought about at the appropriate time by a stepping motor 79 which acts through an endless cable 81 to which the cursor 73 is connected.

Turning now to the output end 47O of the machine 31, the general construction is much like that at the input end 47I but differs in a few details. The rail members 47 OU and 47 OL form the exit segment of the trackway 47, and lead to a vertical outlet slot 83 in the bulkhead 44 (see FIGS. 12 and 13). An exit guide and abutment plate 85 is mounted on the exterior of the bulkhead 44 and is designed to cooperate with a receiving stacker generally indicated at 87. The receiving stacker 87 has not been shown in detail since it is substantially identical with the input hopper 49 except for being of opposite hand. The tray upon which the plates P are stacked is indicated by reference number 257 and guide flange 257D operates in a manner similar to flange 57D on the tray 57.

Figure 13:
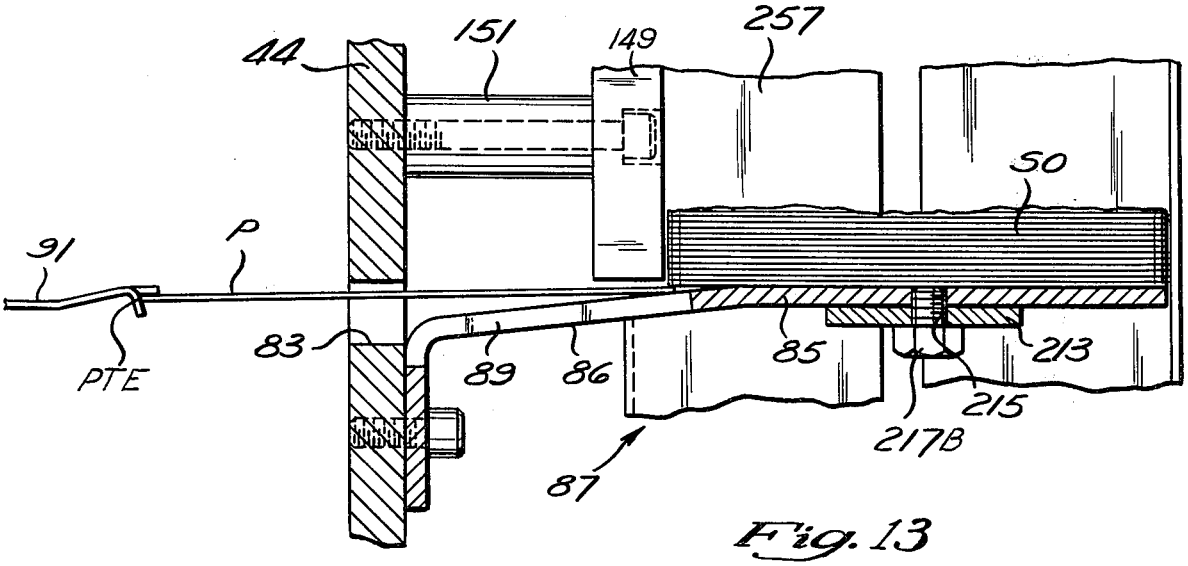
FIG. 13 is a detail section taken on a horizontal plane through line 13—13 of FIG. 12.

As seen in FIG. 13 the abutment plate 85 has a sloping section 86 which will guide the lead edge of the plate P against the face of the stack SO of already embossed plates P, it being understood that the direction of embossing is such that the embossed face of each plate P will be upwardly directed as seen in FIG. 13 so that the lead edge encounters no obstructions to its entry between the abutment plate 85 and the plate stack SO.

The pusher which causes the plate P to move onto the receiver tray 257 is indicated by reference character 91 and the abutment plate 85 is appropriately slotted as at 89 to accommodate the tip of the pusher 91.

The pusher 91 is carried and driven by a cursor 93 also slidable on the rods 75, 77 and powered by a reversible motor 95 by way of a cable transmission 97.

Referring to the frame system which is centrally located in the machine 31 and controls motion of the workpiece P during embossing, the horizontal motion of the outer frame 39 is controlled as shown in FIG. 10 by a pair of stepping motors 99 and 101 both acting on the same continuous cable system 103.

Motors 99 and 101 have pulleys 99A and 101A of diameters which differ by a small amount. When motors 99 and 101 are stepped in unison such that their effects are additive, macro movements of the frame 39 are achieved. When the motion of these motors 99, 101 are in opposite directions, such that their efforts are subtractive, small increments of motion of the frame 39 are achieved allowing the precise positioning of the frame 39 required for accurate embossing. By a combination of forward and reverse rotational steps of the two motors 99, 101, rapid frame motion over comparatively large distances is achieved for unloading and loading plates P between embossing operations; also achieved is precise positioning of the frame 39 at a selected location for accurate embossing. FIG. 11 shows the drive arrangement for raising and lowering the vertically moving frame 43, comprising the reversible stepping motor 105 acting through the cable system 107. This system 107 is not continuous and has the cable anchored on the machine frame 109A at points 109 and 111 which points are provided with adjustment means 109B to allow cable tensioning and precise location of frame 43.

Figure 7:
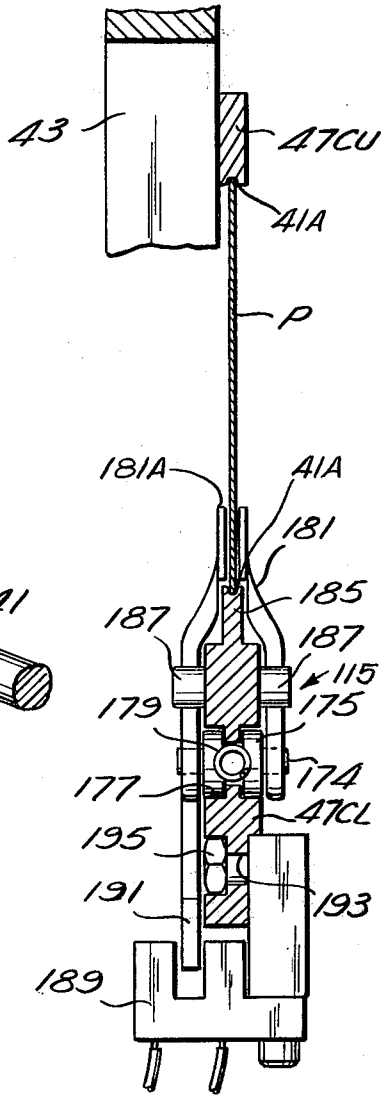
FIG. 7 is a detail section taken substantially on the line 7—7 of FIG. 6.
Figure 6:
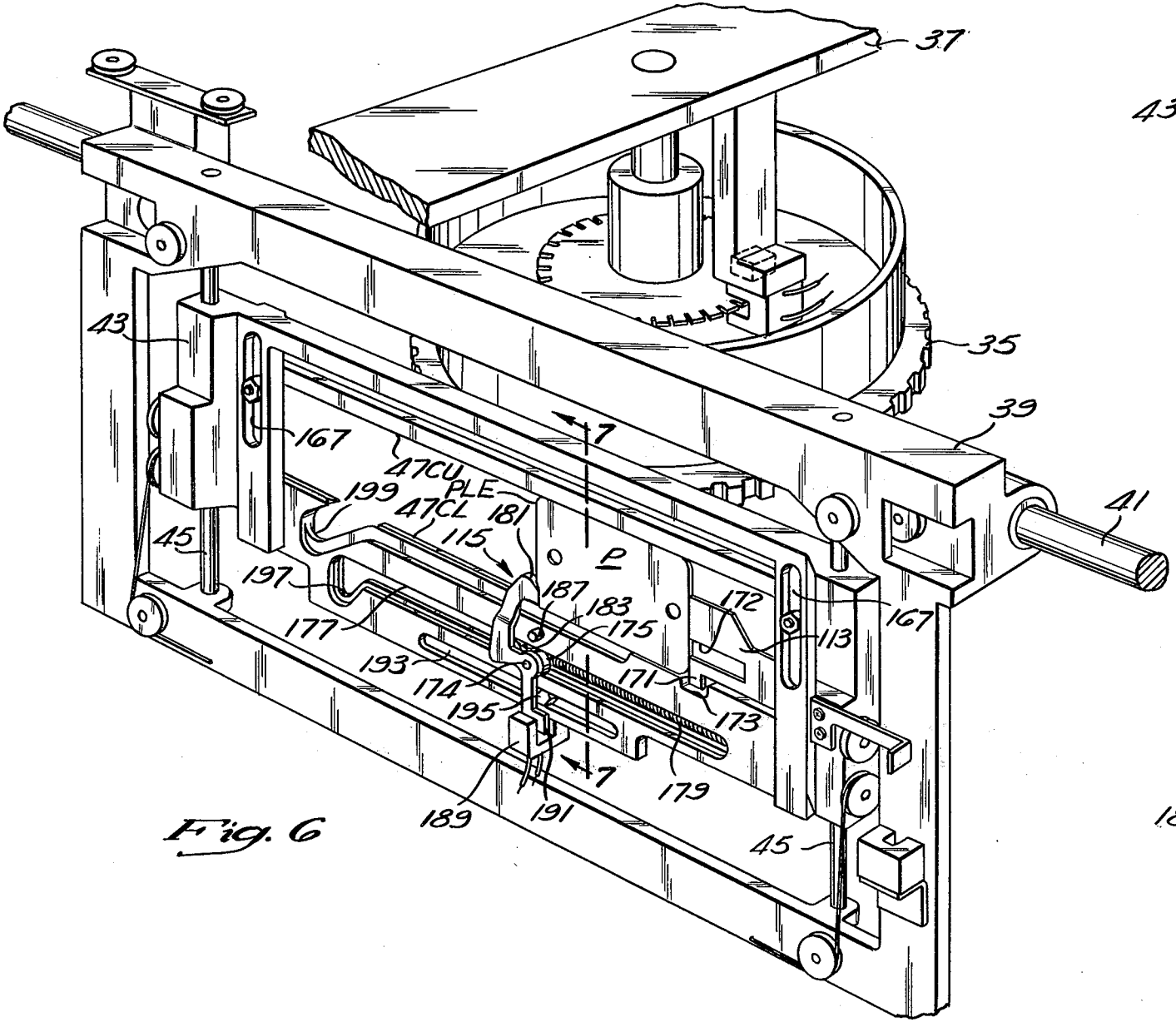
FIG. 6 is a view similar to FIG. 5, except that it is taken from the opposite side of the assembly as indicated by line 6—6 in FIG. 5, the picker mechanism being omitted, and one of the embossing heads included for locational reference.

As shown in FIGS. 5 to 7 there are associated with the track segment 47 CU, 47 CL certain plate locating mechanisms. The first is a plate locating abutment 113 which is so mounted as to lie across the track 47 in such a manner that an incoming plate P arriving from the left in FIG. 5 must displace it in order to move further along the track 47. Once the plate P has gone beyond this locating abutment 113, the latter is returned to original position and, when the picker 69 withdraws, the plate's trailing edge is kept from retreating along the track 47 by the restored position of the abutment 113. Retention means, including the mechanism generally indicated at 115 is provided to locate the plate P against the abutment 113 and restore it to this reference position following the embossing of each character (which involves a short transit along the track 47 away from the abutment 113 while the plate P is in the grip of the rotating embossing heads 33, 35).

An overall view of the operation can be had by reference to FIG. 8 which illustrates the procedure diagrammatically. At the left hand end, the plates P in the hopper 49 gradually inch forward towards the picker 69 as indicated by arrow A. When a plate P reaches the abutment 55 (position P1), the next time a plate P is called for, the frame 39 is moved to its leftmost position by the motors 99, 101 and cable system 103, and the frame 43 is positioned by its drive system (stepper motor 105 and cable system 107) to align its track segment 47 CU, 47 CL with the input track segment 47 IU, 47 IL. Then the picker 69, engaging the trailing edge PTE of the plate P, moves the same in the direction of arrow B through the entry throat 54, into and through the track segment 47 IU, 47 IL, and finally into the track segment 47 CU, 47 CL where it bypasses the positioning abutment 113 and is settled in position P2 by the plate retention means 115 (FIG. 5). The picker 69 is then retracted to engage the next plate P. The motors 99, 101 and cable system 103 then return the frame 39 to a generally central position and take over the control of plate position, along with motor 105 and cable system 107, to determine character location and line spacing during the embossing operation.

When embossing is complete the motors 99, 101 and cable system 103, together with motor 105 and cable system 107, move the frame 39 to the dotted line position in FIG. 8. The plate P then occupies the position P3 and the track segment 47 CU, 47 CL is in proximity to and aligned with the output track segment 47 OU, 47 OL. At this point the pusher 91 is retracted to its leftmost position shown in broken lines in FIG. 8 where it picks up the trailing edge PTE of the plate P, and the motor 95, through cable system 97 extends the pusher 91 to move the plate P through the track segment 47 OU, 47 OL until the plate P reaches the P4 position in the receiving stacker 87, from which point it gradually recedes in the stacker 87 in the direction of the arrow C as plates P are added to the stack SO.

As stated above, the present invention is adapted to feed and process work pieces P of a wide variety of shapes and sizes and is capable of embossing upon virtually any selected area or areas of such workpieces. FIGS. 17A through 17F, which are all drawn to the same scale, illustrate a group of plates PA, PB, PC, PD, PE, PF which are currently being embossed by a machine 31 in accordance with this invention, and give a clear indication of the variety which the machine 31 can be adjusted to accept.

The features of the machine 31 which bear on providing this flexibility will appear in detail in the following discussion.

Figure 14:
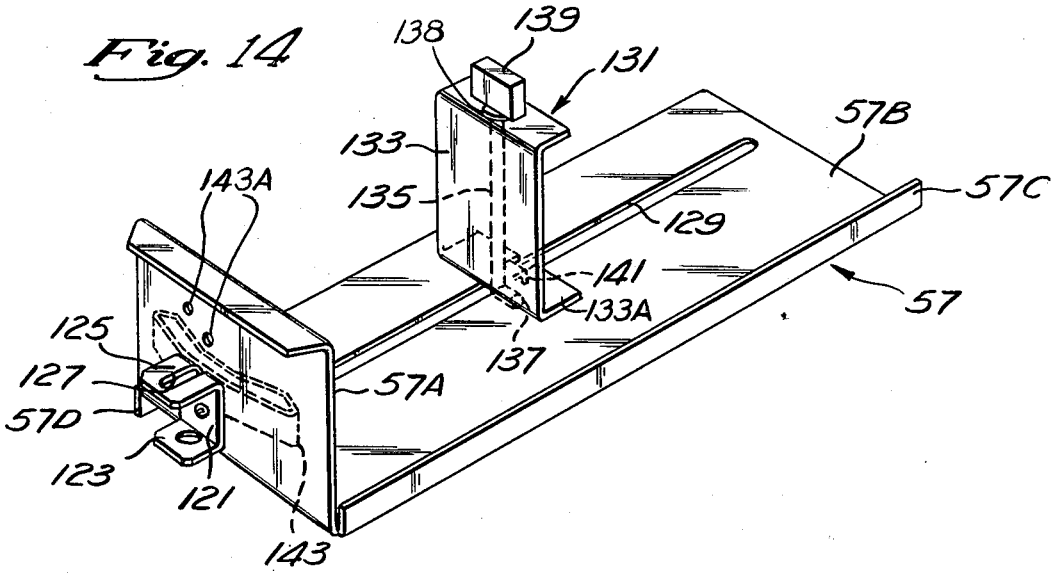
FIG. 14 is a perspective view in detail of a supply hopper tray.

First, referring to the input hopper 49, the general organization appears in FIG. 2, and the tray 57 is shown in more detail in FIG. 14. The tray 57 is of very simple construction being basically a metal plate bent to form a head wall 57A, a floor or horizontal workpiece support 57B, an upwardly turned stop flange 57C and a downwardly turned guide flange 57D. Attached to the exterior of the headwall 57A is a U-shaped bracket 121, the lower arm or tab 123 of which is pierced and functions as previously described and as shown in FIG. 2 herein. The upper arm 125 is provided with a slot 127 whose purpose will presently appear. The support portion 57B has an elongate slot 129 running substantially its full length which provides for a settable plate clamp assembly 131 which may be used to control the plates P when the tray 57 is removed from the machine 31.

The plate clamp assembly 131 comprises a sheet of resilient metal formed into a shallow channel as seen at 133. A shaft 135 is bent at its lower end to provide a laterally extending finger 137, and has a transverse handle 139 affixed to its upper end. The handle 139 lies in contact with the upper flange of the channel 133 (except perhaps for friction reducing spacers 138) and the finger 137 is normally closely adjacent the lower flange 133A of the channel 133. A down-turned tab 141 formed from the lower flange 133A of the channel 133 rides in the slot 129 to maintain proper orientation of the channel 133 perpendicular to the slot 129. The plate clamp assembly 131 can be put into place by turning the handle 139 to orient the finger 137 parallel to the slot 129 and introducing it into the slot 129. With slight pressure the channel 133 can be deformed sufficiently to allow the finger 137 to then be turned crosswise of the slot 129. The clamp assembly 131 will then be strongly frictionally retained at the desired location to hold the plate stack SI in order. The clamp assembly 131 can be removed by turning the handle 139 until finger 137 aligns with the slot 129. Similar manipulations permit the clamp assembly 131 to be stored in the slot 127 in arm 125 when not in use.

Inasmuch as embossed plates P do not always form stacks SO which are altogether regular, perhaps because of a tendency of embossures to partially nest under certain conditions, a pressure equalizing leaf spring 143 is mounted on the head wall 57A and is so arranged that it acts independently on opposite ends of the plates P in the stack SI thereby keeping a substantially equal pressure across the plate P which is located in the abutment 55 contacting position at the throat 54 end of the stack SI. Alternate mounting means 143A are provided so that the spring 143 can be positioned at various levels above the floor 57B of the tray 57 to accommodate plates P of different heights and/or configurations.

Referring now to FIG. 2, the tray 57 is constructed in the fashion shown so that the flange 57C will provide a stop against which the plates P can be registered. The purpose of the guide flange 57D is to enter grooves 59X which are formed in the rollers 59A (i.e. the row or rollers adjacent the bulkhead 42). This provides a precise track which the tray 57 will follow.

Mounted on the bulkhead 42 by posts 147 is a guide rail 145 which, although mounted in a stationary manner on the machine 31, serves in the manner of a side flange for the tray 57. It is so positioned that when the guide flange 57D is in the roller grooves 59X, and the plates P are against the flange 57C, there is a slight clearance between the inner ends of the plates P and the rail 145. Thus as the stack SI of plates P progresses towards the input throat 54, the plates P are held accurately positioned to meet the picker 69 at the correct spot and be properly fed.

The construction just described allows plates P of varying length to be readily accommodated by merely substituting shorter support posts 147 for the rail 145 if the plate P is longer, or longer posts 147 if the plate P is shorter. The trailing edge PTE of each plate P (i.e. the edge upon which the picker 69 will act) thus remains in the same plane regardless of the length of the plate P being processed.

Figure 12:
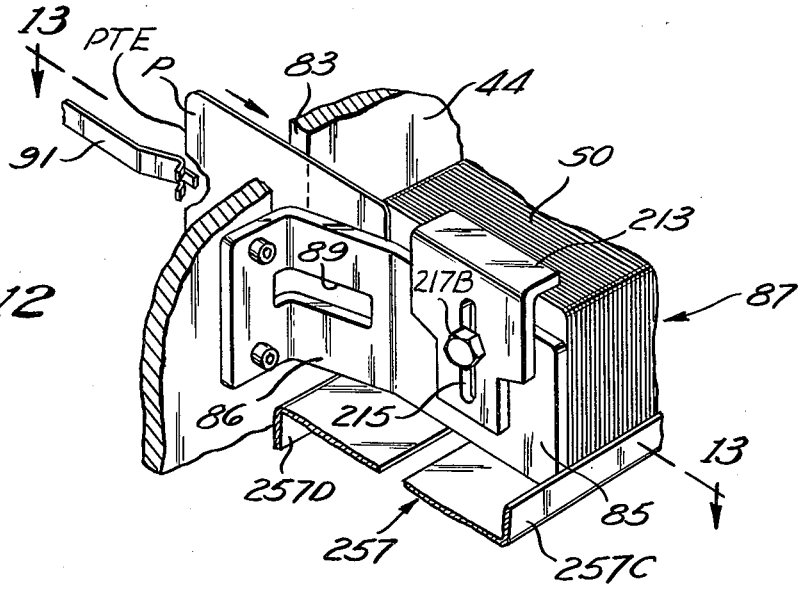
FIG. 12 is a partial detail perspective of the output throat and receiving tray.

As previously indicated, the construction of the receiving stacker 87 is in most respects the same as that of the input hopper 49 except that the parts are of opposite hand, the upturned flange 257C being on the left side of the tray 257 and the downturned guide flange 257D on the right side when facing the head wall 257A from the tray exterior. In other words, their placement relative to the bulkhead 44, as seen in FIG. 12, is the same as for the input hopper 49. It should also be noted that the pusher 91 is acting upon the innermost end PTE of the plate P instead of the outermost end. The device of the invention also provides for using support posts 151 of various lengths to locate the guide rail 149 in a manner to accommodate varying plate lengths. This results in a slightly different operating situation inasmuch as the pusher 91 is acting upon the centrally directed end of the plate P rather than the outwardly directed end. To answer this situation, there is provided in the stepping motor 95 a cutoff switch 153, shown in FIG. 4. This switch 153 is so located that, when activated by the outwardly travelling pusher cursor 93 it de-energizes the motor 95 and terminates pusher travel in the outgoing direction, but does not interfere with energization for reverse motion. As seen in FIG. 4 the switch 153 mounting includes an elongate slot 154 so that the switch 153 can be positioned to terminate travel at a point precisely suited to bring a plate P of any particular length to rest just slightly short of contact with flange 257C of the tray 257.

Turning now particularly to FIGS. 4 through 8, the arrangements for handling, within the track 47, plates P of different heights and varying lengths will be described. In the first place, all three of the upper rails 47 IU, 47 CU, 47 OU of the trackway 47 are shown as having adjustable mountings. Rail section 47 IU is supported on upright brackets 155, 155 by posts 157 which can be clamped at the desired height in slots 159 provided in the brackets 155. Similarly rail section 47 OU has brackets 161, 161 with bracket slots 163 and adjustably positionable posts 165. In the case of rail section 47 CU, the rail is supported directly upon the inner vertically movable frame 43 which itself provides slots 167 allowing the rail section 47 CU to be clamped in a position suited to the height of the plate P. It is a simple adjustment to raise or lower the upper rail 47 IU, 47 CU, 47 OU in each case since the plate positioning devices that were positioned adjacent to the upper rail 47 CU of the inner frame 43 (in certain prior art devices such as the Model E300 embosser mentioned hereinbefore) are no longer positioned adjacent to the upper rail 47 CU.

Figure 9:
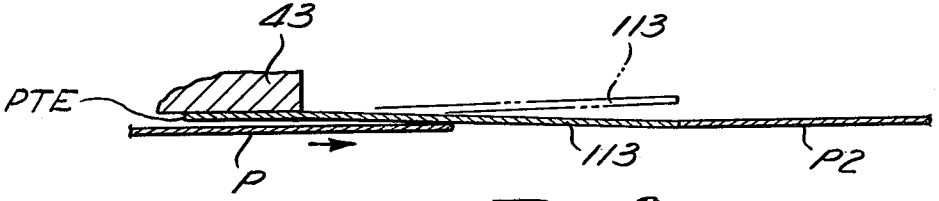
FIG. 9 is an enlarged detail section taken substantially on line 9—9 of FIG. 5.

To provide for plate P positioning, the plate locating abutment 113 is constructed in the form of a thin leaf spring mounted on a vertical structural element of the frame 43 with the slight swinging motion of its tip being in a horizontal direction. The mounting means is seen at 169 in FIG. 5. At its distal end a depending tab 171 fits a notch 173 (FIG. 6) which provides a stop normally aligning the edge of the abutment 113 precisely with the groove 41A of the track 47 so that, even though very thin, it will be an accurate and effective back stop for plates P moving in the track 47. In FIG. 9, which illustrates the operation, it will be noted that the entering plate P (under the control of picker 69), guided by the track rails 47 CU, 47 CL, cams the abutment 113 to one side to the broken line position until the plate P reaches the position marked P2, at which point the abutment 113 springs back to block the track 47 against reverse plate movement. This return movement of the abutment 113 is allowed immediately because a notch 172 is provided in the abutment 113 to accommodate the picker 69 until it can be withdrawn. The notch 172 also serves to permit access of the pusher 91 to the trailing edge PTE of the plate P after embossing is completed and the plate P is to be ejected.

As previously mentioned, a novel retention means holds the plate P against the abutment 113 and this comprises a spring pressed traveller 115 shown in the enlarged cross section of FIG. 7. A shaft 174 carries rollers 175 which travel in an elongate slot 177 in the lower rail member 47 CL. A tension spring 179 of substantial length is attached at one end to the shaft 174 and anchored at its other end to the end of the frame 43 from which the plates P approach. The spring 179 is made of maximum length permitted by the geometry of the system to permit substantial extension without unduly changing the force it applies to the shaft 174.

The plate-contacting portion of the retention means or spring pressed traveler 115 is a finger 181 which has a bell crank configuration, is pivotally mounted on the shaft 174, carries guiding rollers 183 which also ride in slot 177, and an upper extremity 181A spanning the track 47 so as to lie in contact with the plate leading edge PLE. As can be seen in FIG. 7, the roller pairs 175 and 183 straddle a central ridge with the slot 177 to keep the assembly centered with the plate track 47.

The function of the spring 179 is to cause the finger 181 to hold the plate P firmly against the abutment 113 for registration, and then to allow a slight excursion of the plate P while it is under the influence of the punch 33A and die 35A members during embossing by the rotary embossing heads 33, 35. The travel of the finger 181 permitted by the spring 179 also accommodates plates P of varying lengths.

Another feature of the finger 181, which is bifurcated and straddles the track member 47 CL to balance the loading, is that the upper tip portion is guided along a reduced section 185 of the track member 47 CL so that the tip 181A of the finger 181 can be extremely thin in the portion which lies in front of or just below the plate edge PLE. Due to this construction, coupled with the removal of plate positioning features from the upper rail area, there is no longer any chance for interference of the rail 47 CU with the approaching and receding die 35A members of the large diameter rotating embossing heads 35, and plates P can be embossed at any point including their upper and lower margins.

Bosses 187, 187 extend from the track 47 at an appropriate location and serve as stops to prevent unnecessary travel of the finger 181 in a direction towards the locating abutment 113 when a plate P is absent.

Mounted on the lower portion of the rail 47 CL is a sensor 189 which is used as a part of a circuit to detect whether or not a plate P was fed into the embossing position when called for. The sensor 189 is designed to cooperate with a flag 191 depending from one side of the finger 181 which can be positioned to affect the sensor 189. The sensor 189 is so placed that it will be activated by the flag 191 to generate a signal when a plate P is fed, but the flag 191 will not affect the sensor 189 if the finger 181 remains against the boss 187 at the time the plate P is called for. As can be seen in FIGS. 5 and 6, the lower track element 47 CL has an elongate slot 193 which allows the sensor 189 to be clamped in any desired location therealong by the bolt 195. In this manner a sensor location can be selected which gives the proper signal in relation to plates P of different lengths.

As can be seen from FIGS. 5 and 6, there are provided relief notches 197 and 199 near the output end of the lower track member 47 CL. These permit the plate P to escape from the retention means 115 when the pusher 91 is transferring it to the output track segment 47 OU, 47 OL. As the pusher 91 moves the plate P forward, the spring 179 is extended until roller 183 encounters the relief notch 197 of slot 177. As it drops into this relief notch 197, the finger 181 is allowed to pivot about shaft 174 so that the tip 181A of the finger 181 recedes into its relief notch 199 until it lies flush with the track 47 CL and the plate P overruns it, whereupon the spring 179 causes the finger 181 to emerge from the relief notch 199, erect itself, and return to ready position against the bosses 187.

Other features which provide accurate control for plates P of varying sizes and shapes are as follows.

Depending upon the height and/or shape of the plate P, the picker 69 and pusher 91 may need to be at various levels. To this end, the cursors 73 and 93 are fitted with means providing one or more alternate sets of openings 201 (FIGS. 4 and 5) to allow this change in level to be readily effected. When the picker 69 and pusher 91 levels are changed, then it will be necessary to provide a compensating adjustment at the plate locating abutment 113 which can have alternate mounting holes 169A to change its level, or preferably alternate plates notched at different levels, or, if many positions are required, combinations of both approaches may be used. As can be seen in FIGS. 17A to 17F plates PE having the shape shown in FIG. 17E, and preferable also the plate PB having the shape shown in FIG. 17B, require picking and pushing at a low level, and the plate PF shown in FIG. 17F would be picked and pushed at a higher level, and the plate PA shown in FIG. 17A practically requires such higher level picking and pushing.

Figure 17A:
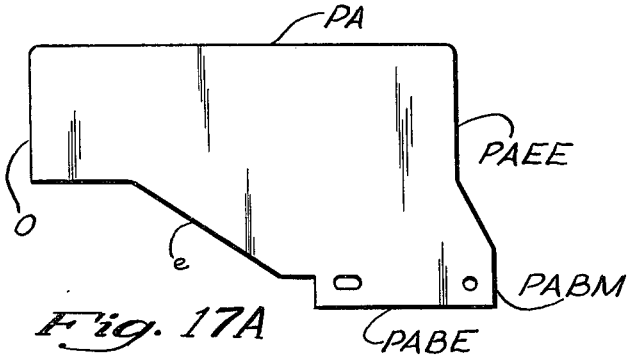
FIGS. 17A to 17F illustrate face views of few of the various types and sizes of plates which the machine of the present invention can be readily adjusted to accommodate.
Figure 17D:
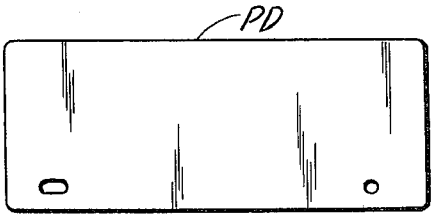

FIG. 17A represents one form of plate PA exemplary of the unusual shapes which can be accommodated by the machine 31 of the present invention, and it will be noted that the plate PA has a very short bottom edge PABE and irregular end edge PAEE. In this particular case the requirement is to emboss the plate PA in such a fashion that the picker 69 and pusher 91 will be in contact with the right edge PAEE as seen in FIG. 17A.

Figure 15:
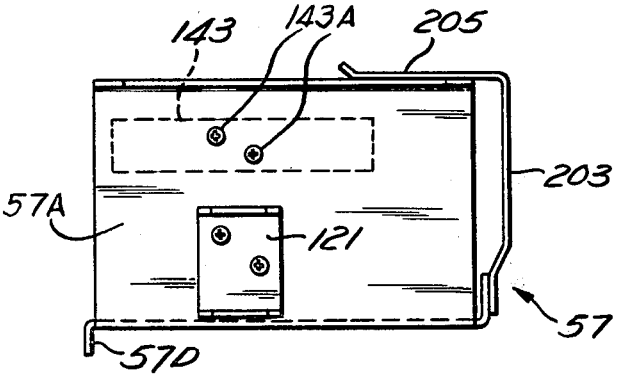
FIG. 15 is an end elevation of a supply hopper tray especially configured to accommodate an unusual plate configuration.

The embossing portion of the operation on the plate PA of FIG. 17A is handled very successfully by the machine 31 as thus far described. After the upper track rails 47 IU, 47 CU, 47 OU are set for the proper height, the pusher 91 and picker 69 are adjusted to a higher position than normal to catch the vertical portion of the edge PAEE, and the finger 181 of the plate retention means 115 seats effectively against the sloping edge e beneath the plate overhang o. In order to supply and stack plates PA of this character, there are certain features required at the hopper 49 and receiver 87. As seen in FIG. 15, the supply tray 57 for the hopper 49 has added to it a side wall 203 and head restraining shelf 205 overlying the end of the plate PA which is full height, thus holding the stack SI against tilting while the tray 57 is being handled and while the plates PA are approaching the feed throat 54 during feeding. At the feed throat position, an overhead guide 207 is provided (see FIG. 2) and this is so mounted that posts 209 of varying lengths can be substituted to match plates P of various heights. The effect of this guide 207 is to hold the plates PA of FIG. 17A against cocking or tilting after they leave the tray 57 and while they are being inserted into the input track segment 47 IU, 47 IL.

Figure 16:
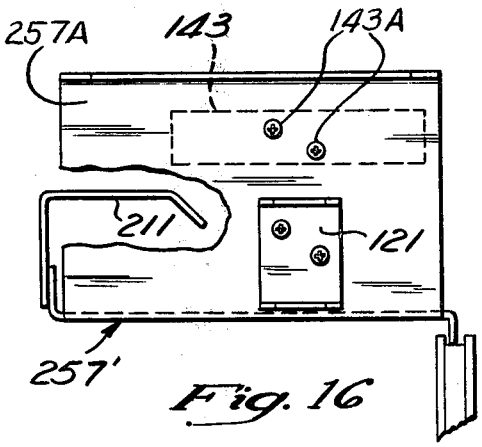
FIG. 16 is an end elevation of a receiving tray corresponding to the supply hopper tray of FIG. 15.

As the plate P issues from the output track segment 47 OU, 47 OL under the influence of the pusher 91 it will enter a special stacker tray 257' configured like that shown in FIG. 16 which is the same as the standard stacker tray 257 except for having lengthwise of the tray 257', a ledge 211 of a height to underlie the overhanging end o of the plate PA and keep it from tilting as it departs from the track 47 and enters the tray 257'. To take care of guiding the plate P during the transition, there is also provided on the abutment 85 (see FIG. 12) an overhead guide 213 which, by way of the slot 215 and clamping bolt 217B, can be adjusted as to height to match the plates P being fed.

Figure 17B:
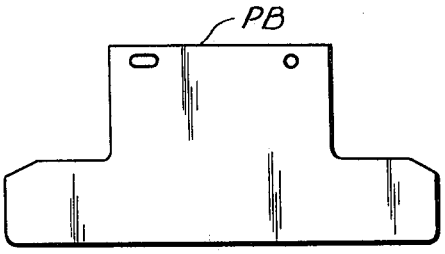
Figure 17E:
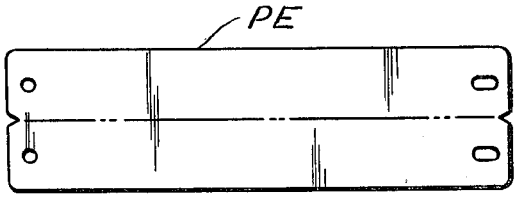
Figure 17C:
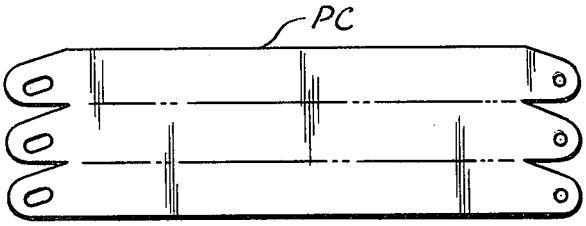
Figure 17F:
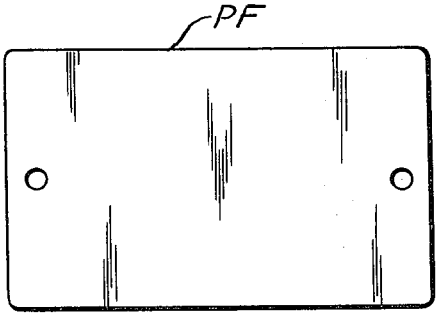

Another important aspect in which the machine 31 is adjustable to meet the requirements of plates of various shapes may be understood by referring to the plates PA, PB shown in FIGS. 17A and 17B. It will be noted that in each case the plate's trailing edge (for example the right hand edge PAEE in FIG. 17A) is not straight but includes a portion which does not coincide with (i.e., does not lie in line with) a normal to the base edge at PABE at its trailing end. If we assume that conditions require that the plate PA, PB be picked and/or pushed at a level higher than the base margin PABM, then we find a situation wherein the base margin PABM of the plate PA will be positioned against (in contact with) the flange 57C of the hopper tray 57, but the picking location will be substantially displaced inwardly from this contact point. While the plate PA will be accurately picked even though the picker 69 would overrun the picking edge PAEE somewhat, a problem would arise since the effective throw of the picker 69 (after encountering the plate edge PAEE) would be insufficient to allow the base margin PABM of the plate PA to clear the plate locating abutment 113, even at full travel. This problem is readily solved by the present invention by merely adjusting the picker mounting so that the range of travel of the picker 69 is displaced inwardly enough to cause the picker tip (at its outward extreme) to just pass the trailing edge of the plate PA. This causes the picker stroke to be such that the picker tip travels inwardly farther than normal (i.e., farther than the stopping point ordinarily associated with rectangular plates P) by the same amount that it was short when picking, thus allowing the projecting base margin PABM of the plate PA to clear the plate locating abutment 113 at the inner limit of travel.

Such an adjustment can be effected easily by reason of the elongate slots 201 on the picker cursor 73 which allow the picker 69 to be clamped in any of various longitudal positions to meet the shape requirement of a particular plate P.

Similar longitudal adjustment of the pusher 91 caan be used to accommodate the out-feeding operation when handling plates PA with the same edge offset characteristics as that of the picked plate PA, using the elongate slots 201 on the pusher cursor 93.

In handling the trays 57 and 257 to load the machine with blank plates P and unload embossed plates P from the machine 31, there is provided a feature which greatly facilitates these loading and unloading operations. This feature takes the form a leaf spring friction retainer 217 mounted on terminal element 217A for each of the traveling blocks 63 in the input hopper 49 and receiving stacker 87. One of the retainers 217 is seen in FIG. 2 and is so arranged that when a tray 57 is to be removed, the tray 57 is merely pushed to the fully extended position in opposition to the aforementioned spring 63A (which normally urges the block 63 towards the abutment 55 or 85). In this event, the retainer 217 engages a pin 219 extending downwardly from the block 63 with sufficient grip to oppose the force of the spring 63A which drives the block 63 and thereby prevents the block's return so that the tray 57 can merely be lifted off. To attach a replacement tray 57, the opening in the arm 123 is placed over the pin 65 and the flange 57D (or 257D) is dropped into the grooved rollers 59X. A slight manual movement of the tray 57 in the direction of the spring action releases the pin 219 from the retainer 217, and the block 63, under the control of the spring 63, again urges the tray 57 towards the corresponding abutment 55.

What is claimed is:

1. In an embossing machine having embossing elements located to operate on a planar workpiece at an embossing site, frame means shiftable in a plane at the embossing site to present various areas of the workpiece sequentially to the embossing elements to receive successive embossed impressions, and means for feeding workpieces to the embossing site for embossment and away from the embossing site for accumulation after embossment wherein said feeding means comprises:

first track means having opposed rails on said frame means for supporting a workpiece by parallel edges during embossment;

inlet track means having opposed rails for guiding a workpiece toward the embossing site, and aligned with said first track means for transferring the workpiece thereto:

outlet track means having opposed rails for guiding a workpiece away from the embossing site and aligned with said first track means for accepting a workpiece therefrom; and means mounting at least one corresponding rail of each track means for ready adjustment towards and away from the other rail to permit convenient adaption of the machine to feeding and embossing of workpieces with substantially different dimensions transversely of their direction of travel through the machine via the track means.

2. In an embossing machine having embossing elements located to operate upon a substantially planar workpiece at an embossing site, a movable frame member carrying two opposing track rails forming a track having a track segment for guiding a workpiece onto the frame member via an entering end and away from the frame member via a departure end, and for supporting a workpiece in an embossment receiving position during the embossing operation, and also having means in the form of a locating abutment means and cooperating workpiece retention means to locate the workpiece in a reference position in the track during embossment, the improvement comprising:

said locating abutment means including a leaf member resiliently mounted at one of its ends on the frame member and having a free end normally positioned to lie substantially in the plane defined by the track segment, said free end being deflectable by a workpiece as said workpiece enters the track segment from the entering end and restorable to normal position to obstruct any return movement of a workpiece once said workpiece has passed the free end of the locating abutment means;

said workpiece retention means comprising finger means mounted for travel along a first of said track rails in position to be encountered by the leading end of an entering workpiece, and means for urging said finger means in a direction to normally retain the workpiece against said locating abutment means;

mounting means including slots permitting ready adjustment of the second of said track rails towards and away from said first track rail to accommodate workpieces of different widths, said second track rail being free of association with either of said locating abutment means and workpiece retention means of such character as to interfere with the ready and rapid adjustment of said second track rail.

3. An embossing machine as set forth in claim 2, in which the resilient mounting of the leaf member results from its own inherent resiliency and the free end of the leaf member includes a stop tab encountering a cooperative gauging surface on said first track rail for assuring the accurate alignment with the free end of the leaf member with the track.

4. An embossing machine as set forth in claim 2, including a mounting means for said finger means comprising an elongate guide slot in said first track rail, a traveller movable in said guide slot and providing a carrier for said finger means, and said urging means comprising an elongate spring urging said carrier towards the locating abutment means.

5. An embossing machine as set forth in claim 4 in which the finger means is also provided with a control element also riding in the elongate guide slot and normally maintaining the finger means so oriented as to position its tip in the path of a workpiece in the track segment.

6. An embossing machine as set forth in claim 5 in which both the elongate guide slot and the said first track rail have relief portions near the departure end of the track segment permitting the control element to swing away from alignment with the elongate guide slot and allowing the force of a departing workpiece to swing the finger means into the track rail relief portion whereby the workpiece can escape therefrom and depart from the track segment.

7. An embossing machine as set forth in claim 2 which also includes a sensing device mounted for readily adjustable positioning in a direction parallel to said second track rail, and an element carried by said finger means for activating said sensing device to give a signal representative of the presence of a workpiece at the embossing site, whereby adjustment of the sensing device can be readily effected to give correct workpiece detection signals for workpieces of various lengths.

8. An embossing machine as set forth in claim 6 in which the leaf member, at least in the portions adjacent the free end, and those portions of the finger means in or adjacent the workpiece path as a workpiece passes through the track segment are both characterized by being of a thickness which is no more than slightly thicker than a workpiece, whereby embossing of a workpiece margin can be effected without interference between said leaf member or finger means.

9. An embossing machine comprising: embossing elements located at an embossing site; track means for guiding a workpiece to the embossing site to receive an embossment and away from the embossing site after the embossing operation; locating abutment means for determining a position along the track means for properly registering a workpiece for embossment; workpiece retention means including a finger for holding the workpiece against the locating abutment means, said workpiece retention means including spring means for both urging the finger towards the locating abutment means and permitting the finger to accommodate workpieces of various lengths; and guide means for said finger allowing said finger to retreat out of the workpiece path at a predetermined path location in response to workpiece force against said finger as the workpiece is moved away from the embossing site against the force of said spring means, to allow escape of the workpiece from the finger for discharge.

10. An embossing machine including embossing elements located at an embossing site; track means having an input end and a discharge end for guiding a workpiece to the embossing site to receive an embossment and away from the embossing site after the embossing operation; means associated with said track means for holding in embossing position workpieces of different lengths; and a supply hopper for supplying workpieces to the input end of said track means, said supply hopper comprising:

a hopper tray for carrying on-edge workpieces;

means for urging said hopper tray in a direction to move the workpieces successively into line with said track means;

means for guiding said hopper tray for movement in a predetermined path normal to said tray means at the input end thereof;

means on the side of the tray remote from the track means providing a register surface for workpieces;

normally fixed workpiece guide means extending parallel to the tray path adjacent the side nearest the track means to maintain workpieces on the hopper tray substantially in contact with the register surface of said hopper tray; and means providing for ready repositioning of said workpiece guide means towards and away from the tray to accommodate workpieces of different lengths.

11. An embossing machine as set forth in claim 10 which further includes a receiving stacker for accepting workpieces from the discharge end of said track means, said receiving stacker comprising:

a stacker tray for carrying on-edge workpieces;

means for guiding said stacker tray for movement in a predetermined path normal to said track means at the discharge end thereof;

means on the side of the stacker tray remote from the track means providing a register surface for the workpieces;

normally fixed stacker workpiece guide means extending parallel to the stacker tray path adjacent the side nearest the track means to maintain workpieces on the stacker tray substantially in contact with the register surface of said stacker tray; and means providing for ready repositioning of said stacker workpiece guide means towards and away from the stacker tray to accommodate workpieces of different lengths.

12. An embossing machine including embossing elements located an an embossing site; track means having an input end and a discharge end for guiding a workpiece to the embossing site to receive an embossment and away from the embossing site after the embossing operation; means associated with said track means for holding in embossing position workpieces of different lengths; and a receiving stacker for accepting workpieces from the discharge end of said track means, said receiving stacker comprising:

a stacker tray for carrying on-edge workpieces;

means for guiding said stacker tray for movement in a predetermined path normal to said track means at the discharge end thereof;

means on the side of the stacker tray remote from the track means providing a register surface for workpieces;

normally fixed workpiece guide means extending parallel to the stacker tray path adjacent the side nearest the track means to maintain workpieces on the stacker tray substantially in contact with the register surface of said stacker tray; and means proving for ready repositioning of said workpiece guide means towards and away from the stacker tray to accommodate workpieces of different lengths.

13. An embossing machine including embossing elements located at an embossing site, track means for guding a workpiece to the embossing site to receive an embossment and away from the embossing site after the embossing operation; input hopper means at an input end of the track means; and means for transporting a workpiece from a stack of workpieces in the input hopper means to the embossing site via said track means comprising:

a cursor;

means for driving the cursor in a reciprocatory manner adjacent and parallel to said track means;

a picker arm carried by said cursor and including a picker element for picking a workpiece by encountering its trailing edge at the input hopper means and moving the workpiece through said track means to the embossing site; and means for mounting the picker arm in alternate locations transversely of the track means to cause the picker element to encounter the workpiece at a selected one of plural positions across the trailing edge of the workpiece, whereby to make possible accommodation of workpieces of different widths and shapes.

14. An embossing machine as set forth in claim 13 in which there is also provided means for adjusting the degree of projection of the picker arm from the cursor in a direction lengthwise of the track means to permit location of the picker element to accommodate workpieces with variously shaped trailing edges.

15. An embossing machine including embossing elements located at an embossing site; track means for guiding a workpiece to the embossing site to receive an embossment and away from the embossing site after the embossing operation; receiving stacker means at a discharge end of the track means; and means for transporting a workpiece from the embossing site to the receiving stacker means via said track means comprising:

a discharge cursor;

means for driving the discharge cursor in a reciprocatory manner adjacent and parallel to said track means;

a pusher arm carried by said discharge cursor and including a pusher element for encountering the trailing edge of the workpiece as said workpiece leaves the embossing site and moving the workpiece through said track means to the receiving stacker means; and means for mounting the pusher arm in alternate locations transversely of the track means to cause the pusher element to encounter the workpiece at a selected one of plural positions across the trailing edge of the workpiece, whereby to make possible accommodation of workpieces of different widths and shapes.

16. An embossing machine as set forth in claim 15 in which there is also provided means for adjusting the degree of projection of the pusher arm from the discharge cursor in a direction lengthwise of the track means to permit location of the pusher element to accommodate workpieces with variously shaped trailing edges.

17. An embossing machine as set forth in claim 15 in which the means for driving the discharge cursor comprises an electric motor and a limit switch which when activated, terminates motor operation in the discharge direction of the discharge cursor; means for mounting said limit switch in the path of movement of said discharge cursor for activation by said discharge cursor when the workpiece has been moved into a predetermined position within the receiving stacker means; and means for adjusting the point in the travel of the discharge cursor at which the discharge cursor encounters the limit switch to provide for feeding workpieces of different lengths.

18. An embossing machine including embossing elements at an embossing site; a supply hopper; a receiving stacker; said supply hopper and receiving stacker each having a workpiece support surface; track means for guiding workpieces from the supply hopper through the embossing site to the receiving stacker; means defining a workpiece registration location within the track means at said embossing site; picker means including a picker element for moving a workpiece from the supply hopper to the registration location defining means; and pusher means including a pusher element for moving a workpiece from the registration location defining means to the receving stacker; the improvement comprising:

said supply hopper including a first registration member determining the initial position of the workpiece with respect to the trailing edge thereof;

said receiving stacker including a second registration member for determining the final position of the workpiece with respect to the leading edge thereof;

first guide means associated with said supply hopper, and means for adjusting the first guide means with respect to said first registration member to accommodate workpieces of different length;

second guide means associated with said receiving stacker, and means for adjusting the second guide means with respect to said second registration member to accommodate workpieces of different length;

said pusher means including a motive means;

a control circuit means, coacting with said motive means, to activate or deactivate said motive means, said control circuit means including a limit switch which, when activated by contact with a moving portion of the pusher means, terminates a driving effect of the motive means on the pusher element; and means for adjusting the location of contact occurrence between said movable portion of the pusher means and the limit switch to provide for feeding workpieces of different lengths;

said workpiece registration location defining means including a stop member and a retention finger urging a workpiece against the stop member, and a spring for causing the finger to urge a workpiece against the stop member which spring is so constructed as to be capable of substantial deformation in a direction lengthwise of the track means without undue change in force, whereby to accommodate workpieces of substantially different lengths.

19. An embossing machine as set forth in claim 18 which further includes:

means for adjustably mounting said picker element and said pusher element in a direction lengthwise of the track means to accommodate workpieces whose trailing edges are characterized by offset portions at the area of contact with the picker and pusher elements.

20. An embossing machine as set forth in claim 18 in which the track means comprises two parallel rail means for edge guiding workpieces from the supply hopper to the receiving stacker, and in which one of said rail means has a mounting which is fixed in relation to the workpiece support surfaces of the supply hopper and receiving stacker and in which there is provided means for readily effecting adjustment of the other of said rail means towards and away from the one rail means in order to accommodate workpieces of different widths.

21. An embossing machine as set forth in claim 18 in which there is also provided a frame means shiftable in a plane at the embossing site to present various areas of the workpiece sequentially to the embossing elements to receive successive embossed impressions, and in which the track means comprises:

a first track segment having opposed rails on said frame means for supporting a workpiece by parallel edges during embossment;

an inlet track segment having opposed rails for guiding a workpiece toward the embossing site, said first track segment being alignable therewith for receiving a workpiece therefrom;

an outlet track segment having opposed rails for guiding a workpiece away from the embossing site, said first track segment being alignable therewith for releasing a workpiece thereto; and means mounting at least one corresponding rail of each of the first track segment, the inlet track segment and the outlet track segment for ready adjustment towards and away from the other corresponding rail thereof in each case to accommodate workpieces of different widths.

22. An embossing machine as set forth in claim 21 in which the means defining a workpiece registration location are so situated as to define the registration location with respect to the first track segment on said frame means and which also includes the improvements comprising:

said stop member comprising a leaf member resiliently mounted at one of its ends on the frame means and having a free end normally positioned to lie substantially in the plane defined by the first track segment, said free end being deflectable by a workpiece as said workpiece enters the first track segment from the inlet track segment and restorable to normal position to obstruct any return movement of a workpiece once said workpiece has passed the free end of the leaf member;

said retention finger being mounted for travel along a first one of the rails of said first track segment in position to be encountered by the leading end of an entering workpiece, and said spring acting upon said retention finger in a direction to normally retain the workpiece against said stop member;

a second one of the rails of said first track segment being free of association with either of said stop member and workpiece retention finger, said stop member and said workpiece retention finger being of such character as not to interfere with the ready and rapid adjustment of said second one of the rails of said first track segment.

23. An embossing machine as set forth in claim 22 which further includes guide means for said retention finger associated with said second one of the rails allowing the retention finger to retreat out of the workpiece path at a predetermined path location in response to workpiece force against the retention finger as the workpiece is moved away from the embossing site against the force of said spring to allow escape of the workpiece from the retention finger for discharge.

24. An embossing machine as set forth in claim 34 in which the supply hopper comprises:

a hopper tray having a support surface for carrying on-edge workpieces;

means for urging said hopper tray in a direction to move the workpieces successively into line with said track means;

means for guiding said hopper tray for movement in a predetermined path normal to said track means at the input end thereof;

means on the side of the hopper tray remote from the track means providing said first registration member for workpieces;

said first guide means comprising normally fixed first workpiece guide means extending parallel to the tray path adjacent the side nearest the track means to maintain workpieces on the hopper tray substantially in contact with said first registration member; and means providing for ready repositioning of said first guide means towards and away from the hopper tray to accommodate workpieces of different lengths; and in which the receiving stacker comprises:

a stacker tray having a support surface for carrying on-edge workpieces;

means for guiding said stacker tray for movement in a predetermined path normal to said track means at the discharge end thereof;

means on the side of the stacker tray remote from the track means providing said second registration member for workpieces;

said second guide means comprising normally fixed second workpiece guide means extending parallel to the stacker tray path adjacent the side nearest the track means to maintain workpieces on the stacker tray substantially in contact with said second registration member; and means providing for ready repositioning of said second workpiece guide means towards and away from the stacker tray to accommodate workpieces of different lengths.

25. An embossing machine as set forth in claim 24 arranged for use with workpieces which are so configured as to have a bottom edge significantly shorter than the workpiece length and significantly remote from an end of the workpiece thereby defining a workpiece overhang, wherein one of said trays further comprises a head restraining shelf overlying the support surface, parallel thereto and extending substantially from end to end thereof, and means free of connection with the side of the one tray nearest the track means for connecting said shelf with and supporting said shelf upon other portions of the one tray; and wherein the other of said trays further comprises ledge providing means for underlying the workpiece overhang, said ledge providing means extending lengthwise of said support surface at the side of the other tray remote from the track means.

26. An embossing machine as set forth in claim 24 which also includes fixed abutments, one adjacent the entry end of the track means and one adjacent the exit end of the track means for aligning the endmost workpieces on thehopper tray and the receiving stacker tray each with said track means; and which further includes an overhead guide member mounted adjacent each abutment and positionable in close proximity to the upper edge of the endmost workpiece of a stack on the associated tray to guard against tilting of said endmost workpiece as said workpiece travels between the stack and the track means in those cases where the lower edge of the endmost workpiece is much shorter than the upper edge, or in which the level at which endmost workpiece is contacted to move said endmost workpiece is displaced from the ideal thrust level; and means mounting said overhead guide member for ready height adjustment to accommodate workpieces of different width.

27. An embossing machine as set forth in claim 24 in which the stacker tray is provided with a headwall and includes a force equalizing device comprising spring means mounted on said headwall and so configured as to act substantially independently upon spaced parts of a workpiece stack supported upon said support surface of said stacker tray which parts are spaced from each other in a direction breadthwise of said support surface of said stacker tray, and in which there is further provided means for positioning said spring means on said headwall at a selected one of various distances from said support surface of said stacker tray to provide for different widths and configurations of workpieces.

28. An embossing machine as set forth in claim 24 which includes means for selectively mounting both the picker element relative to the remainder of the picker means, and the pusher element relative to the remainder of the pusher means for ready positioning in alternative locations, transversely of the track means as well as in their degree of projection lengthwise of the track means.

29. In an embossing machine, a stack controlling device for a workpiece stack comprising:

means providing a throat for passing individual workpieces between a feed path and a workpiece stack extending normal thereto;

an abutment adjacent said throat for receiving the thrust of said workpiece stack and guiding a workpiece through the throat between the end of the workpiece stack and said feed path;

a tray for carrying said workpiece stack in on-edge position and having a head plate;

means for urging the tray in a direction normal to the feed path to compress a workpiece stack on the tray between the head plate and the abutment;

rollers for supporting said tray as said tray is moved towards or away from said abutment;

a rib depending from said tray, normal to the feed path, at least some of said rollers having aligned grooves for receiving said rib and guiding the tray in a predetermined path;

means on said tray extending normal to the feed path providing a register surface for the ends of the workpieces at the side away from said throat;

means mounted independently of said tray and adjacent thereto on the side towards the throat providing a workpiece guide surface extending normal to said feed path and parallel to said register surface; and means providing for ready positioning of said guide surface means at various selected positions towards and away from said tray to accommodate workpieces of different length.

30. An embossing machine as set forth in claim 29 in which the stack controlling device is a supply hopper for supplying workpieces to said feed path, and which also includes in addition a further stack-controlling device according to claim 21 serving as a receiving stacker for receiving completed workpieces from the feed path.

31. An embossing machine as set forth in claim 29 in which there is mounted adjacent the abutment an overhead guide member positionable in close proximity to the upper edge of the endmost workpiece of a workpiece stack on the tray to guard against tilting of said endmost workpiece as said endmost workpiece travels between the workpiece stack and the feed path in those cases where the lower edge of said endmost workpiece is much shorter than the upper edge, or in which the level at which the endmost workpiece is contacted is displaced from the ideal thrust level; and means mounting said overhead guide member for ready height adjustment to accommodate workpieces of different width.

32. A tray for holding workpieces associated with an embossing machine comprising a sheet formed to provide a workpiece support surface, an upturned headwall, an upturned workpiece register flange along one side of the support surface, a downturned flange on the opposite side of the support surface serving as a guide rib for aligning the tray with its usage path in the embossing machine; and a connection device adjacent said headwall for readily attaching and detaching the tray from an urging mechanism on the embossing machine.

33. A tray as set forth in claim 32 which also includes a slot extending lengthwise of the support surface; and a clamping assembly for retaining workpieces on the tray when the tray is removed from the machine comprising: a resilient sheet formed into a shallow channel, an operating member including a rod having two ends, said rod extending across the channel and extending through openings in the sides thereof; a transverse foot member on one end of the rod and a handle on the other end of said rod, whereby the foot member may be introduced into the slot and, via the handle, turned to a position extending transversely of the slot to grip between itself and a side of the resilient channel the margin of the support surface adjacent the slot, and thus be placed at a selected location along the slot to clamp between itself and the headwall a stack of workpieces on the tray.

34. A tray as set forth in claim 33 which further includes a storage member associated with the exterior of said headwall providing an auxiliary slotted support surface to which the clamping assembly can be attached when not in use.

35. A tray as set forth in claim 32 for use with workpieces which are so configured as to have a bottom edge significantly shorter than the workpiece length and significantly remote from an end of the workpiece, which further comprises a head restraining shelf overlying the support surface, parallel thereto and extending substantially from end to end thereof, and means free of connection with the side of the tray provided with the downturned flange for connecting said shelf with and supporting said shelf upon other portions of the tray.

36. A tray as set forth in claim 32 for use with workpieces which are so configured as to have a bottom edge significantly shorter than the workpiece length and significantly remote from an end of the workpiece and defining a workpiece overhang, which further comprises ledge providing means for underlying the workpiece overhang, said ledge providing means extending lengthwise of said support surface at the side of the tray remote from that provided with the downturned flange.

37. A tray as set forth in claim 32 which further includes a force equalizing device comprising spring means mounted on said headwall and so configured as to act substantially independently upon spaced parts of a workpiece stack supported upon said support surface which parts are spaced from each other in a direction breadthwise of said support surface.

38. A tray as set forth in claim 37 in which means are provided for positioning said spring means on said headwall at a selected one of various distances from said support surface to provide for different widths and configurations of workpieces.

39. In an embossing machine, a stack controlling device for workpiece stacks comprising:

means providing a throat for passing individual workpieces between a feed path and a stack of workpieces extending normal thereto;

an abutment adjacent said throat for receiving the thrust of said stack of workpieces and guiding said individual workpieces between the end of said stack of workpieces and the feed path;

a tray for carrying said stack of workpieces in on-edge position and having a head plate;

means for urging the tray in a direction normal to the feed path to compress said stack of workpieces on the tray between the head plate and the abutment, said urging means comprising guide means, extending parallel to the direction of tray travel, a traveler slidable on said guide means and means for normally driving said traveler towards said abutment;

means for connecting said tray with said traveler and for facilitating convenient detachment therefrom;

a terminal element at the end of said guide means remote from said abutment; and cooperating detent means on said traveler and said terminal element, active when the tray is pushed to a limiting position towards said terminal element to coact and capture the traveler and temporarily overcome the effect thereupon of said means for urging, thereby allowing the tray to be manually removed and replaced without the traveler escaping to an undesired position, said detent means also being activatable by manual force applied to the tray, when in place upon the traveler, to cause release of the traveler for normal operation.

* * * * *